US005261549A

United States Patent [19]

King et al.

[11] Patent Number: 5,261,549

[45] Date of Patent: Nov. 16, 1993

[54] MISCELLANEOUS ARTICLE STORAGE AND RETRIEVAL APPARATUS

[76] Inventors: Charles W. King; Jane M. King, both of 570 Elm Way, Edmonds, Wash. 98020

[21] Appl. No.: 982,335

[22] Filed: Nov. 27, 1992

[51] Int. Cl.[5] ..... B65D 85/20

[52] U.S. Cl. ..... 220/4.27; 220/23.86; 206/509

[58] Field of Search ..... 220/520, 4.27, 4.26, 220/23.83, 23.80; 206/509, 349

[56] References Cited

U.S. PATENT DOCUMENTS 1,396,361 11/1921 Davidson ..... 220/520
2,558,124 6/1951 Burden ..... 220/520
3,459,327 8/1969 Harris ..... 220/520
3,542,445 11/1970 Joyce .
3,861,556 1/1975 Barecki et al. .
4,667,822 5/1987 Coopmans ..... 206/509
4,813,521 3/1989 Goldstone .
4,875,744 10/1989 Wettstein .
4,890,741 1/1990 Edelstein ..... 220/520

*Primary Examiner*—Joseph Man-Fu Moy
*Attorney, Agent, or Firm*—Henderson & Sturm

[57] ABSTRACT

A small article storage and retrieval apparatus (10) for storing, transporting, sorting and retrieving a plurality of diverse articles (100); wherein, the apparatus (10) comprises a plurality of generally L-shaped nesting receptacle members (20); wherein, each receptacle member (20) has a receptacle portion (30) and an enlarged shallow sorting portion (40) disposed generally perpendicular to one another.

7 Claims, 1 Drawing Sheet

MISCELLANEOUS ARTICLE STORAGE AND RETRIEVAL APPARATUS

TECHNICAL FIELD

The present invention relates to the field of nesting storage containers in general, and in particular to an apparatus that facilitates the storage and retrieval of a plurality of miscellaneous articles.

BACKGROUND ART

As can be seen by reference to the following U.S. Pat. Nos. 4,875,744; 4,813,521; 3,861,556; and 3,542,446; the prior art is replete with myriad and diverse storage container devices.

While all of the aforementioned prior art constructions are more than adequate for the basic purpose and function for which they have been specifically designed, these patented devices are uniformly deficient with regard to their providing both a storage and retrieval capability for the miscellaneous articles that are contained within the devices.

As anyone who deals with small diverse sized articles on even an infrequent basis is intimately aware, storage of such articles does not present a major problem; however, the retrieval of the desired type and number of such articles normally requires substantial space to spread the articles around on a flat surface in order to make the paper selection.

As a consequence of the foregoing situation, there has existed a longstanding need among both homeowners and even skilled craftsmen for a new type of storage and retrieval apparatus that will allow the user to both store and spread the stored contents relative to the same basic storage receptacle; and the provision of such a construction is a stated objective of the present invention.

DISCLOSURE OF THE INVENTION

Briefly stated, the storage and retrieval apparat that forms the basis of the present invention comprises a plurality of nesting receptacle units; wherein, each receptacle unit comprises a storage receptacle portion and a sorting tray portion.

In addition each of the receptacle units cooperates with the other receptacle units to retain the miscellaneous articles contained therein in either the storage or retrieval mode.

As will be explained in greater detail further on in the specification, each of the larger receptacle units also function as a carrier that can be used to transport the smaller receptacle units nested therein; wherein a raised lip of the sorting tray portion of the largest receptacle unit functions as a handle that will facilitate the transport of the nested units from one location to another.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
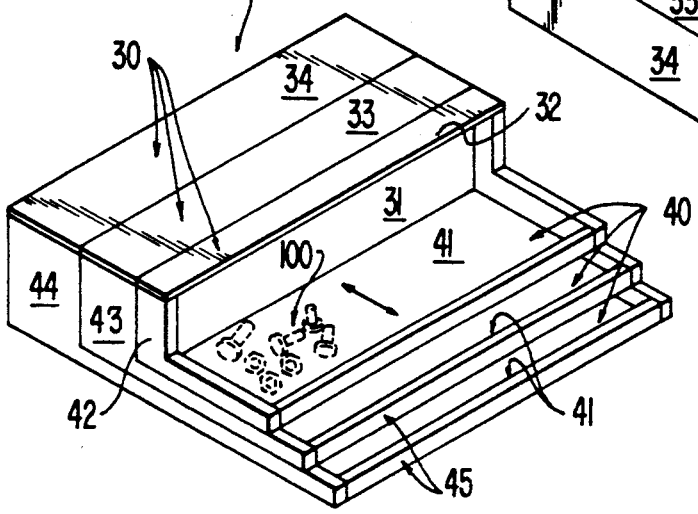
FIG. 1 is a perspective view of the storage and retrieval apparatus disposed in the retrieval mode.

As can be seen by reference to the drawings, and in particular to FIG. 1, the small article storage and retrieval apparatus that forms the basis of the present invention is designated generally by the reference numeral (10). The apparatus (10) comprises in general a plurality of receptacle units (11) that nest together in a rather unique fashion.

Figure 2:
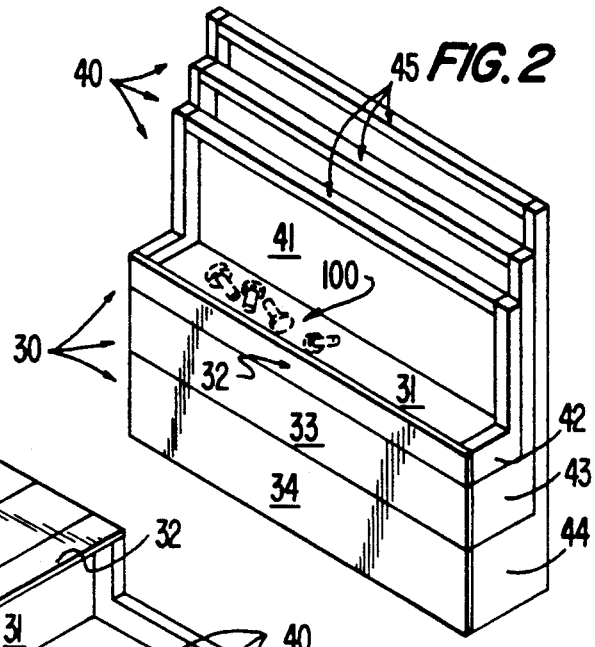
FIG. 2 is a perspective view of the apparatus disposed in the storage mode.
Figure 6:
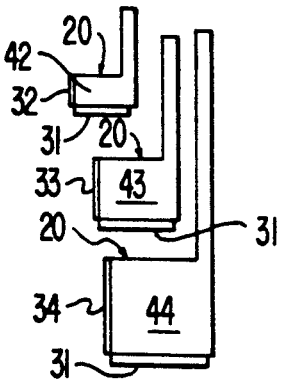
FIG. 6 is an exploded side view of the apparatus in the storage mode.

As can best be seen by reference to FIGS. 2 and 6, each of the receptacle units (11) comprise a generally L-shaped receptacle member (20) having a relatively deep receptacle portion (30) and a relatively shallow sorting portion (40).

As shown in FIGS. 1, and 2, the receptacle portion (30) and the sorting portion (40) share common wall surfaces; wherein, the floor (31) of the receptacle portion (30) forms the rear wall of the sorting portion; and the floor (41) of the sorting portion (40) forms the rear wall of the receptacle portion.

Figure 3:
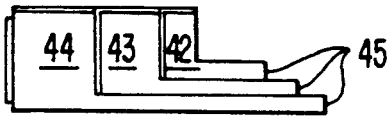
FIG. 3 is a side plan view of the apparatus in the retrieval mode.
Figure 4:
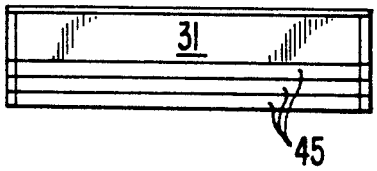
FIG. 4 is a front plan view of the apparatus in the retrieval mode.

Turning now to FIGS. 2, 3, and 6, it can be seen that the receptacle portions (30) and the sorting portions (40) each share common generally L-shaped pairs of side walls (42) (43) (44) having different dimensions; wherein the different dimensions will be discussed in greater detail presently.

Figure 5:
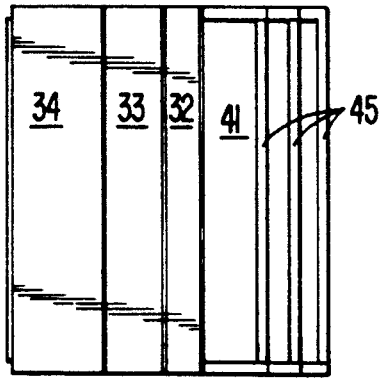
FIG. 5 is a top plan view of the apparatus in the retrieval mode.

As shown in FIGS. 5 and 6, the receptacle portions (30) are each provided with elongated generally rectangular front panels (32) (33) (34) having the same length and different widths as will be explained presently.

In addition as shown in FIGS. 1 and 2, each of the sorting portions (40) are provided with a generally rectangular uniformly dimensioned raised lips (45) which also serves as a carrying handle for one or more of the receptacle members (20), when the receptacle members (20) are disposed in the storage mode depicted in FIG. 2.

As can best be seen by reference to FIGS. 3 and 6, the floor (31) of each receptacle portion (30) is provided with beveled edges so that the receptacle portions (30) will assume a nesting relationship relative to one another.

Furthermore, the legs of each pair of generally L-shaped side panels (42) (43) (44) have the same width as the raised lips (45) on each of the sorting portions; while the feet of each pair of side panels (42) (43) (44) have different widths such that the front panels (32) (33) (34) are aligned in the same plane when the receptacle members (20) are disposed in a nesting fashion.

By now it should be appreciated that the storage and retrieval apparatus (10) of this invention comprises a plurality of nesting receptacle members (20); wherein, each receptacle member (20) has a receptacle portion (30) and a sorting portion (40) which become operative in their intended modes of disposition where they are disposed in the vertical and horizontal orientations respectively.

In addition, each of the progressively smaller receptacle members (20) are dimensioned to nest within the next larger receptacle member (20); such that the front and sides of the nested receptacle members are aligned;

while the raised lip (45) of the largest receptacle member (20) forms a carrying handle for all of the smaller receptacle members (20) contained therein.

In this manner, the storage and retrieval apparatus (10) allows a plurality of diverse articles (100) to be stored and transported in the receptacle portions (30) of each receptacle member (20) when the apparatus (10) is disposed in the vertical orientation.

Then when articles (100) are to be retrieved from the apparatus (10), the apparatus (10) is tilted into the horizontal disposition; such that all of the articles in each of the receptacle portions (30) of the receptacle members (20) are spread out across the respective sorting portions (40) for easy retrieval of selected articles (100).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A storage and retrieval apparatus for storing, transporting and facilitating the sorting and retrieval of diverse, discrete articles; wherein, the apparatus comprises:

a plurality of similarly configured, yet differently dimensioned receptacle members; wherein, each receptacle member includes an enlarged receptacle portion and an elongated shallow sorting portion, wherein each receptacle portion is dimensioned to stack with another receptacle portion of another receptacle member and the receptacle portion and the sorting portion are each provided with floors that are disposed generally perpendicular to one another; and wherein, the floors of the respective differently dimensioned receptacle and sorting portions each share one common dimension; whereby, when the floor of the sorting portions of each receptacle member are disposed in the vertical orientation, said discrete articles are contained within the receptacle portions of each receptacle member; and, when the floor of the sorting portions of each receptacle member are disposed in the horizontal orientation, said discrete articles are contained within the sorting portions of each receptacle member.

2. The apparatus as in claim 1; wherein, the receptacle portion and the sorting portion each share common side walls.

3. The apparatus as in claim 2; wherein, the sorting portion of each receptacle member is provided with a raised lip which serves as a carrying handle for not only both the individual receptacle members; but also for any smaller receptacle member nested within a larger receptacle member.

4. The apparatus as in claim 3; wherein, each of the receptacle portions of each receptacle member is provided with a front panel.

5. The apparatus as in claim 4; wherein, each of the front panels of each receptacle member are aligned with one another when the receptacle members are disposed in a nested relationship.

6. The apparatus as in claim 2; wherein, each of the common sidewalls of the receptacle members have a generally L-shaped configuration.

7. The apparatus as in claim 1; wherein, the floors of the receptacle portions of each receptacle member are beveled to facilitate the nesting relationship between the respective receptacle members.

* * * * *